United States Patent [19]

Harris et al.

[11] 4,228,912

[45] Oct. 21, 1980

[54] CONTAINER

[75] Inventors: Clifford E. Harris, Billericay; Norman B. Spary, Chatham, both of England

[73] Assignee: EPS (Research and Development) Limited, Sittingbourne, England

[21] Appl. No.: 968,414

[22] Filed: Dec. 11, 1978

Related U.S. Application Data

[63] Continuation-in-part of Ser. No. 714,398, Aug. 16, 1976, abandoned.

[51] Int. Cl.[3] ..... B65D 6/32

[52] U.S. Cl. ..... 220/4 R; 220/80; 220/81 R; 220/339; 264/157; 264/261; 264/263

[58] Field of Search ..... 220/4 R, 357, 358, 80, 220/81 R, 221, 339, 234, 349; 144/309 A, 309 D; 277/207 B; 264/261, 250, 255, 263, 157, 297, 328

[56] References Cited

U.S. PATENT DOCUMENTS

| | | | |
|---|---|---|---|
| 203,486 | 5/1878 | Myers | 144/318 |
| 1,622,664 | 3/1927 | Murray et al. | 29/469 |
| 1,705,436 | 3/1929 | Zerenga | 144/319 |
| 2,181,912 | 12/1939 | Ries | 144/318 |
| 2,261,416 | 11/1941 | Schrier | 264/267 |
| 2,392,734 | 1/1946 | Haberstump | 264/263 |
| 2,604,426 | 7/1952 | Beekman | 264/261 |
| 2,837,365 | 6/1958 | Schleuter | 220/81 R |
| 3,014,611 | 12/1961 | Marshall | 264/201 |
| 3,047,910 | 8/1962 | Downs | 264/267 |
| 3,087,207 | 4/1963 | Styra | 264/259 |
| 3,104,012 | 9/1963 | Beamish | 229/2.5 |
| 3,119,540 | 1/1964 | Schenk et al. | 229/2.5 |
| 3,475,530 | 10/1969 | Cooper | 264/251 |
| 3,511,902 | 5/1970 | Santangelo | 264/251 |
| 3,716,259 | 2/1973 | Weill et al. | 220/80 |
| 4,049,368 | 9/1977 | Grachten | 264/261 |

FOREIGN PATENT DOCUMENTS

| | | | |
|---|---|---|---|
| 872149 | 5/1942 | France | 264/261 |
| 265566 | 9/1927 | United Kingdom . | |
| 779660 | 7/1957 | United Kingdom . | |
| 1203305 | 8/1970 | United Kingdom . | |
| 1306795 | 2/1973 | United Kingdom . | |
| 1418317 | 12/1975 | United Kingdom . | |

OTHER PUBLICATIONS

Polyurethanes, 2nd Ed., Bernard A. Dombrow, Reinhold Publishing Corp., N.Y., 1965, pp. 149–151.

Freeman, Silicones, ILIFFE Books, London (1964), pp. 76–79, 93 & 94.

Saunders et al., Polyurethanes, Chem. & Tech. Interscience, N.Y., (1966), pp. 333, 335–338, 650 & 651.

*Primary Examiner*—Thomas P. Pavelko

*Attorney, Agent, or Firm*—Parmelee, Miller, Welsh & Kratz

[57] ABSTRACT

A container is formed by locating two panels in a jig so that the two panels have their adjacent edges nearly touching, the panels being in perpendicular planes. A mould is provided at the adjacent edges of the panels, and a casting resin is introduced to the mould to secure the panels together. Two pairs of panels thus formed are joined together in a similar way to form the walls of a container, and a base and lid are also connected to the walls in a similar way. The casting resin is a cold curing casting resin which, when cured is flexible. The panels are thus interconnected by flexible joints. The container is resistant against damage when dropped.

13 Claims, 8 Drawing Figures

CONTAINER

RELATED APPLICATIONS

This application is a continuation-in-part of Ser. No. 714,398, filed Aug. 16, 1976, now abandoned.

BACKGROUND OF THE INVENTION

This invention relates to a structure and a method of making a structure in the form of a container such as a box. The invention particularly relates to containers for use in transporting and storing items of equipment such as military equipment. Prior proposed containers for transporting and storing equipment such as military equipment have previously been made as strong and rigid as possible to prevent damage to the equipment.

OBJECT OF THE INVENTION

The present invention seeks to provide a container which prevents the equipment within the container being damaged when the container is dropped and subjected to other shocks, but which is yet simple and quick to manufacture.

SUMMARY OF THE INVENTION

According to one aspect of this invention there is provided a packaging container produced by a method comprising the steps of locating a number of panels in a jig, so that the panels are in the relative positions they will occupy in the finished structure, the adjacent edges of the panels nearly touching, locating mould means adjacent to the nearly touching edges, introducing a flowable cold-curing elastomeric casting resin into said mould means, said casting resin, when cured, comprising a flexible element securing said panels together to form a structure forming element having a waterproof and shockproof joint and subsequently securing at least one further panel to said structure forming element to form a container having waterproof and shockproof corners.

According to another aspect of this invention there is provided a packaging container produced by a method comprising the steps of locating a number of panels in a jig so that the panels are in the relative position that they will occupy in the finished structure, the adjacent edges of the panels nearly touching, locating mould means immediately next to said nearly touching edges, introducing a flowable cold-curing elastomeric casting resin into said mould means, said casting resin, when cured, forming a flexible element connecting said panels together to form a structure forming element having a waterproof and shockproof joint, subsequently securing at least one further panel to said structure forming element to form a container having waterproof and shockproof corners, and seperating the container into two sections by cutting at least one panel thereof.

According to yet another aspect of this invention there is provided a packaging container comprising a plurality of panels defining at least side walls and base of said containers, each panel being connected to each adjacent panel by a flexible connecting member, each said flexible connecting member being formed by casting the member, in situ, from a flowable cold curing elastomeric casting resin, the flexible connecting member constituting a water-proof and shock proof joint between the panels.

DESCRIPTION OF PREFERRED EMBODIMENTS

Figure 1:
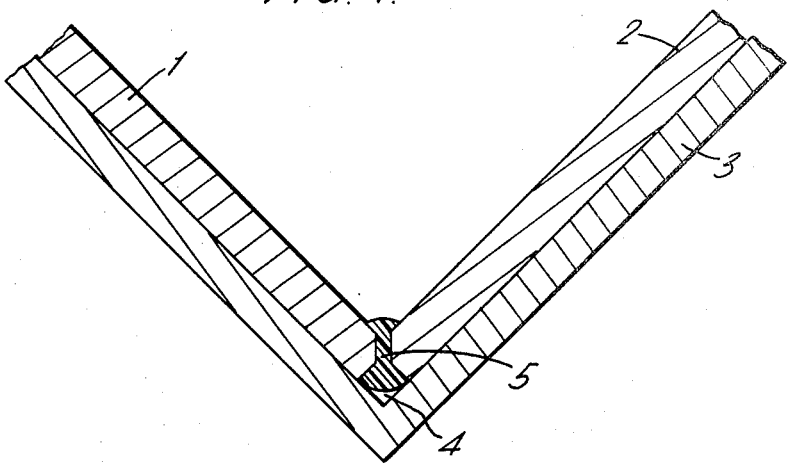
FIG. 1 shows a vertical cross-section through two panels secured together on a "V" shaped jig.

In the following description reference is made to cold curing casting resins, termed casting resins for simplicity. It is to be understood that such a material is a material which, when initially prepared, is in a flowing or liquid state, although the liquid may have a relatively high viscosity. The liquid may be poured into a mould, and the liquid will set or cure at room temperature without the application of heat. The cast resin may then be removed from the mould.

In the present invention a cold curing casting resin is used which, when set, is flexible. The flexible material forms a flexible and waterproof joint between adjacent panels of a container. The use of such a flexible joint has not been proposed before, and it has been found that containers made with such flexible joints can withstand violent shocks without the containers being damaged and without items stored in the containers being damaged.

In the present invention the preferred cold curing casting resin comprises a two-part urethan resin. One particularly preferred type of resin comprises polyurethane and is based on a first component comprising polyether polyol together with one or more catalysts, and fillers and pigments if desired, this component being reacted with a second component which comprises an MDI type isocyanate, thus forming the elastomeric polyurethane.

It is preferred that the viscosity of the polyether polyol component shall be such that, at a temperature of 24° C. (±1° C.), 100 g. of the component will pass through a No. 4 Ford Cup Viscometer in not more that five minutes. The preferred density of the polyether polyol component, at the above specified temperature, is not less than 1.35 and not more than 1.45 g/cm$^2$.

It is preferred that the gel time of thhe cold curing resin shall be not less than 180 seconds and not more than 300 seconds when 100 g. of the above described polyether polyol component is mixed with the optimum amount of the isocyanate, at the above specified temperature, and stirred by hand for thirty seconds. The gel time is considered to be the elapsed time from completion of stirring until the cured resin cannot be marked by a spatula.

It is preferred that the cold curing resin is such that when a specimen of the cold curing resin has been conditioned at room temperature for twenty-four hours the hardness of the specimen, when measured by means of a Shore Durometer according to British Standard 903 shall not be less than 55, and shall not be more than 60.

Also it is preferred that, when tested according to British Standard Method 301E, the tensile strength of such a room temperature conditioned sample shall not be less than 14.0 $Kg/cm^2$ (200 $lb/in^2$) and the elongation at break shall not be less than 200%, and, when tested according to British Standard 308A the tear strength shall not be less than 8.5 Kg/cm (50 lb/in).

Also it is preferred that the cold curing casting resin is such that when two plywood panels are interconnected at right angles, as will hereinafter be described with reference to FIG. 1 of the accompanying drawings, the two panels may be distorted by bending them so that the included angle between the joints is at least 135°, and preferably 180°, three times, with an interval of at least ten seconds between each such deformation and the next deformation, without failure of the joint.

A suitable cold curing resin for use in this invention may be prepared by mixing polyether polyol reference 2851/702 and isocyanate reference 2875/003 as obtained from Macpherson Polymers (U.K.)Ltd., Radcliffe Road, Bury, Lancashire, England. This particular resin includes a catalyst made under licence under British Pat. No. 1,053,383 of Minnesota Mining and Manufacturing Co. Ltd.

A structure made by a method in accordance with the invention, for example, in the form of a packing case, is formed from a plurality of panels. The panels may be made of various materials, such as, for example, timber, carton board or corrugated fibre board, hardboard, zinc plated steel laminated to hardboard, primed aluminium or a plastics material in sheet form. Such plastics material may be reinforced with a reinforcing material such as glass fibre or metal, for example, in the form of a metal mesh.

Referring to FIG. 1, in order to form a generally cubic structure or container in the form of a packing case by one method in accordance with the invention, two panels 1 and 2 which are to form adjacent side panels of the container are placed in a substantially "V" shaped jig 3 and are clamped so that the panels are mutually perpendicular and so that their adjacent edges are nearly touching, the panels being located in the relative positions that they will occupy in the completed container. The side edges of the panels which are to be joined are provided with chamfered portions extending over half their width to assist accurate positioning of the panels in the jig, with the aid of a distance piece, and also to minimise the quantity of resin used forming a joint. The chamfers also avoid local high stress concentrations in the joint to be formed. The surfaces of the jig are coated with silicone varnish as a release agent, and a silicone rubber fillet 4 is provided immediately next to the nearly touching edges of the adjacent panels, said fillet having two mutually perpendicular surfaces contacting said jig and a curved surface there between. A casting resin is poured into the space between the fillet and the almost touching panels to fill it to a height where the resin forms a joint extending between the almost touching panels. The cured resin adheres strongly to the panels holding them together with a permanently waterproof joint 5, the panels being in mutually perpendicular relationship. Experiment has shown that 3 grams of resin per inch is required to form an adequately strong joint when using panels $\frac{3}{8}''$ thick.

A second pair of panels is then joined together in a similar manner, and then the two pairs of panels are joined together so that the panels form a prefabricated assembly of side panels of a cubic container, the pairs of panels being joined in a similar jig, one edge at a time.

In forming the jointed edges the fillet utilised to shape the casting resin is dimensioned and shaped to form a small extension of the resin forming the joint at each end of the joint, the extension being of a height substantially equal to the thickness of the panels to be utilised to form the base and lid of the container. These extensions assist in accurate positioning of the side panels in relation to the base and lid panel.

The base and lid panels are then secured to the side panels by using an open mould which may, for example, be built up on a support board.

The open mould comprises a support board which is provided with side walls which determine the outside dimensions of the container to be formed. The base panel is laid in a suitable position within the side walls, and a further board is laid on the base panel. This further board is of substantially the same size as the base panel, and has curved edges shaped to provide a joint formed adjacent the further board with a smooth, curved surface. However, if the base panel is thicker than the side panels the further board is not needed and may be omitted.

To secure the base panel and further board in position during the moulding operation a steel sheet is placed on the inside of the further board and an electro magnet is located under the mould, activation of the electro magnet urging the further board towards the support board. To avoid casting resin creeping between the further board and the panels forming the container, gaskets made, for example, from sheets of silicone rubber, may be placed at appropriate locations.

Casing resin is subsequently poured into the built-up spaced defined between the open mould, the further board and the side edges of the base panel, and the prefabricated assembly of side panels is then placed in position in the space. The extensions of the cast resin forming the joints between adjacent side panels ensure that the side panels are positioned in correct relationship to the base panel. When the resin is cured the electro magnet is switched off, the steel plate and further board lifted out and the base panel is left secured by means of a waterproof joint to the side panels.

The lid panel, if a lid is to be provided, is secured to the side panels in a precisely similar manner, and if necessary reinforcements of metal or glass fibre can be inserted in the joints between the base panel and the lid panel and the side panels, as the joints are made.

When the lid panel has been secured to the side panels to form a completed container body a lid is separated from the container by sawing through the lid panel at a suitable position.

The edges of the lid and the edge of the portion of the lid panel remaining secured to the container body are provided with sealing members by locating appropriately shaped moulds adjacent the free edges of the lid and the lid panel of the container body, and by filling the moulds with a casting resin. Thus these cast sections will be strongly secured to the edges, and will be free from any joints in their periphery, the cast sections thus being waterproof. To provide a waterproof joint when the lid is located in position it is preferred that the sealing member formed on the lid is a female section, and the sealing member provided on the edge of the lid panel of the container body is desirably a male section. It is envisaged that it will be advantageous for the female section to be cast from a resin which sets off harder than the male section. The container is then provided with appropriate catches, hinges and handles.

Figure 2:
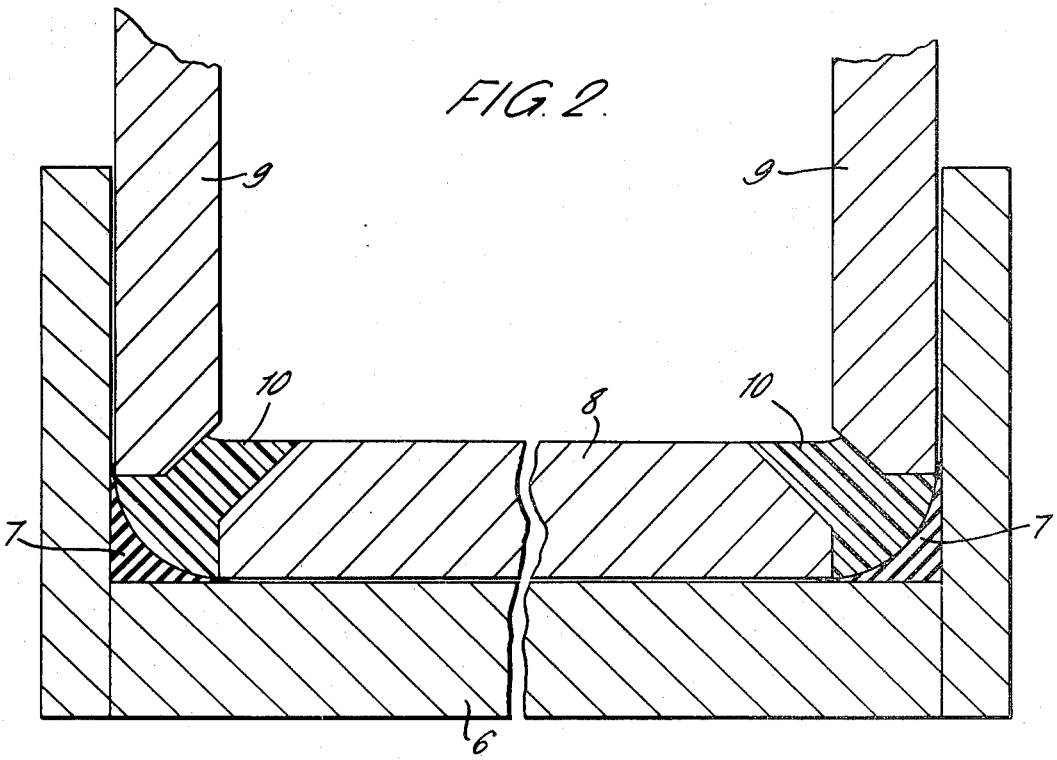
FIG. 2 shows a vertical cross-section through a jig for securing a lid or base panel to a prefabricated assembly of side panels.

In an alternative and preferred embodiment of the invention the side panels of a container are assembled together as above described and the lid and base panels are then in turn secured to the side panels by using an open mould, as shown in FIG. 2. The open mould comprises a shallow, open box 6 with internal dimensions which determine the outside dimensions of the container to be formed. The internal side edges of the base of the open box are fitted with silicone rubber fillets 7. Each fillet 7 has two perpendicular walls, one of which contacts the base of the box and the other of which contacts the interior of a side wall of the box. Between the two perpendicular walls is a curved wall-shaped to provide a joint to be formed adjacent the fillet with a smooth curved external surface. Each fillet is made to extend up the side walls and along the base of the box to provide a resilient seating for the side and base panels of the container so that the moulded elastomer is finished with a clean edge. Initially a lid panel 8 is located within the box and then a prefabricated assembly of side panels 9 is positioned, so that the side panels and the lid panel are in the relative positions that they will occupy in the finished container. Casting resin is then poured into the space defined between the lid panel and the prefabricated assembly of side panels and the fillets. When cured, the resin comprises a waterproof joint 10 securing the lid panel to the prefabricated assembly of side panels to form a container body portion.

An opening section is then separated from the container body portion by sawing through all the side panels at a suitable position adjacent the lid forming panel.

A base panel is then secured to the container body portion by a substantially similar method to that used for securing the lid panel to the side panels, to produce a completed container body portion and separate lid section.

Figure 3:
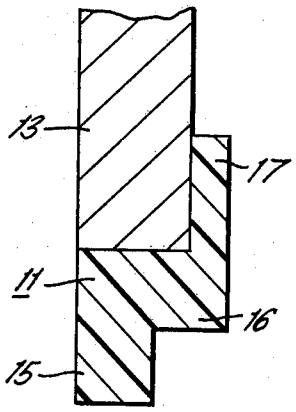
FIG. 3 shows a vertical cross-section through two co-operating sealing members formed at the edges of panels.
Figure 4:
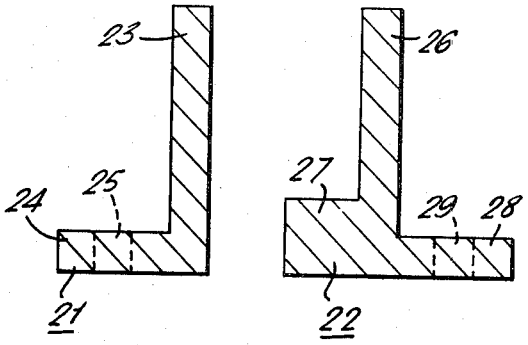
FIG. 4 shows a vertical cross-section through mould members for use in producing sealing members as illustrated in FIG. 3.
Figure 4:
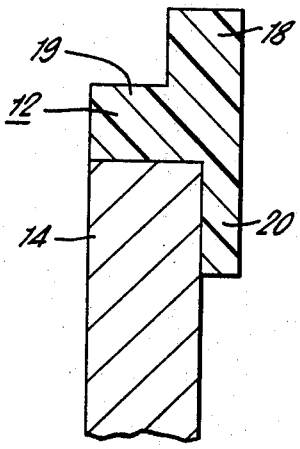
Figure 5:
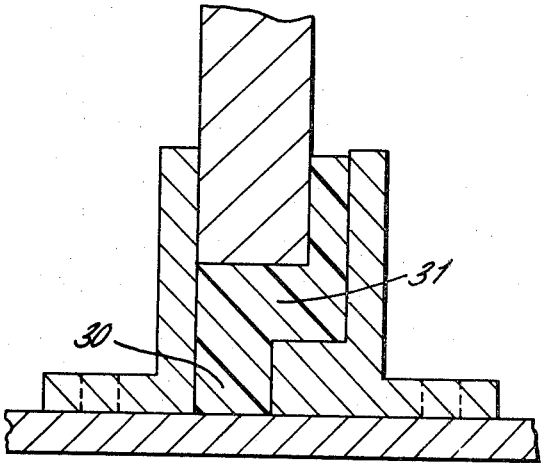
FIG. 5 shows the mould members of FIG. 4 assembled on a base board, with a panel edge in position in casting resin contained in the mould.

The edges of the lid section and the container body portion are provided with sealing members of the form shown in FIG. 3. The sealing members comprise cooperating sections, of cast resin 11 and 12 which are secured to the edges of the lid section 13 and of the container body portion 14. These resin sections are produced by means of aluminium mould members 21 and 22, shown in FIG. 4, which are assembled on a base board to produce a mould. Mould member 21 comprises an upright member 23 and a horizontal flange 24 having a hole 25 therethrough for attaching the mould member to the base board, by means of a screw, for example. Mould member 22 comprises an upright member 26 having a protuberance 27 at its base and the horizontal flange 28 having a hole 29 for attachment of the mould member to the base board. The mould produced by assembling the mould members 21 and 22 on the base board comprises a trough having a narrow lower section 30 and a wider upper section 31, as shown in FIG. 5. A release-agent is applied to the mould, and the mould is then filled with casting resin. The edge of the lid section or body portion is then placed in position inside the mould, with the edge of the lid section adjacent mould member 21 as shown in FIG. 5, or the edge of the body portion adjacent mould member 22, as appropriate, so that resin is forced up the inside face. When cast, the resin is strongly secured to the edge of the panel and forms a waterproof sealing member. As shown in FIG. 3, the sealing member 11 attached to the edge of the lid section 13 comprises an approximately Z shaped section of resin having a projection 15, a recess 16 and an extension of resin on the inside face 17. The sealing member 12 attached to the edge of the body portion 14 comprises an approximately T shaped section of resin having a projection 18 corresponding with recess 16, a recess 19 corresponding with projection 15 and an extension of resin on the inside face 20. Experiments have shown that 16.5 grams of resin is required per inch in the formation of a sealing member.

Whilst a particular form of sealing member has been described it is to be appreciated that the sealing members may have many shapes.

Figure 6:
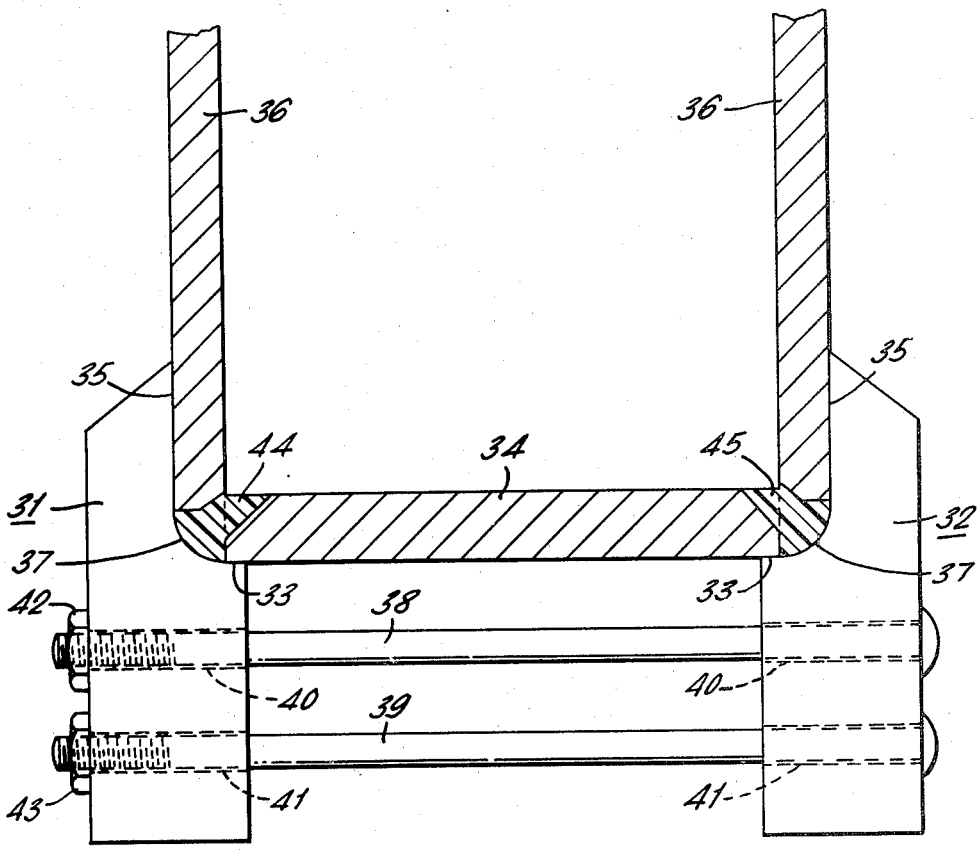
FIG. 6 shows a vertical cross-section through an adjustable jig for securing a lid or base panel to a prefabricated assembly of side panels.

In a further method in accordance with the invention for forming a generally cubic container, lid and base panels are secured to a prefabricated assembly of side panels, which is formed as is described above, by using an adjustable jig as shown in FIG. 6.

The jig comprises two similar shaped blocks, 31 and 32, each with a recess provided adjacent a top edge of the block. The portions of the block defining the recess comprise a horizontal surface 33, for contact with the bottom of a lid panel 34, a vertical surface 35 for contact with a prefabricated assembly of side panels 36 and a curved surface 37 shaped to provide a joint to be formed adjacent the surface with a smooth curved external surface. Two threaded bolts 38 and 39, pass through two holes, 40 and 41, in the base of each of the blocks. The bolts are used to adjust the separation of blocks 31 and 32 by means of nuts 42 and 43. The jig is adjusted until it is an appropriate size to accommodate the panels to be joined. A lid panel 34 and a prefabricated assembly of side panel 36 are located and positioned in the recesses of the jig so that the side panels and the lid panels are in the relative positions that they will occupy in the finished containers. Casting resin is poured into the space defined between the edges of the lid panel, the edges of the side panels to be joined and the curved surfaces 37 of the blocks of the jig. The recess is shaped, or blocking elements are provided, such that the resin is retained in the space to form the joint and cannot escape beyond the edges of the panels being joined. Because the jig is adjustable only two sides can be joined in one operation. When the resin is cured it forms waterproof joints 44 and 45. The assembly of sides is then removed from the jig, turned 90° about its vertical axis and fitted back into the jig. Casting resin is then poured into the spaces defined between the edges remaining to be joined and when set, forms two additional waterproof joints. A lid section is removed from the container body portion as described above. A base panel is secured to the container body portion using the adjustable jig to produce a completed container body portion and separate lid section.

In an alternative embodiment of the invention, used for forming a generally cubic open topped or closed container, the joints securing the edges of the side panels of the container are moulded in a jig consisting of four corner posts assembled on a base. The base is provided with a grid of holes spaced at 1 inch intervals in perpendicular directions, and a number of shoes adapted to be attached to the base by using selected holes in order to define the plan size of the container to be formed. The base is therefore adjustable, and can be used in the formation of containers of different sizes.

Figure 7:
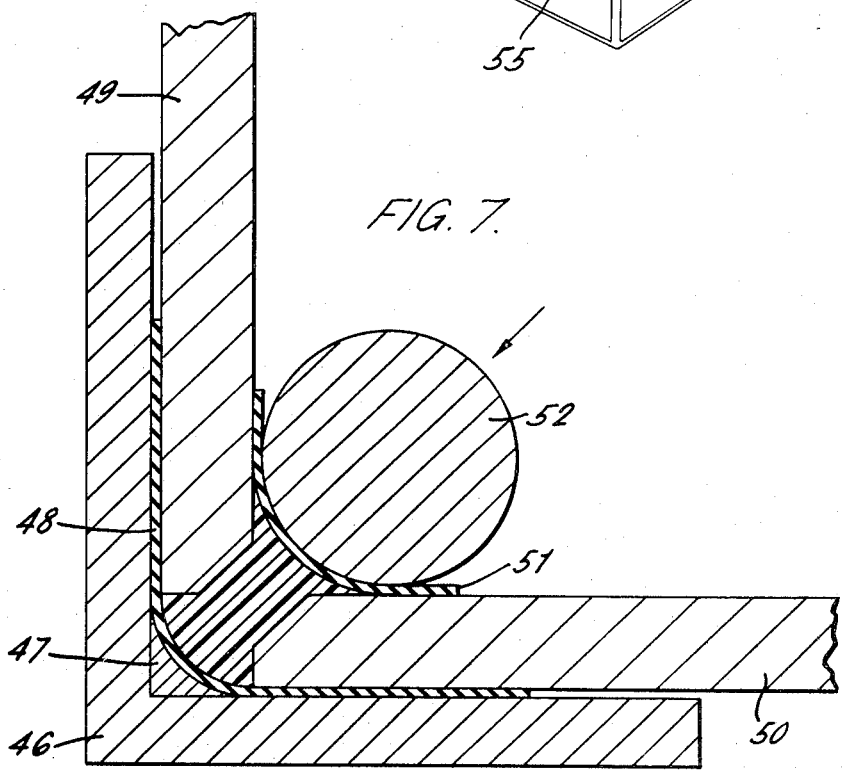
FIG. 7 shows a horizontal cross-section through a corner post assembly.

Each corner post, as shown in FIG. 7, consists of an angle section 46 with a fillet 47 at its inside edge formed by a resilient membrane 48. Two panels 49 and 50 are placed in position so that the panels are mutually perpendicular and so that their adjacent edges are nearly touching, the panels being located in the relative positions that they will occupy in the completed container, and the corner assembly is completed by a resilient membrane 51 and a steel bar 52. Three other corner assemblies are completed in a similar manner, and the completed assembly is then strapped and braced at the top and whenever necessary to ensure uniform pressure on the resilient membranes defining the moulds. Casting resin is then poured into the four moulds between the panel edges. The viscosity of the resin used in this vertical pouring method is reduced by adding white spirit. Experiment has shown that with one inch diameter steel bars the joint consumes three grams of resin per inch. When cured, the resin forms four waterproof joints which hold the side panels together. This vertical pouring method has the advantage that four corner joints can be fabricated at once. The base and lid panels are then secured to the prefabricated assembly of side panels by a method described previously if a closed container is to be manufactured, but only a base panel will be provided if an open-topped container is to be manufactured.

Figure 8:
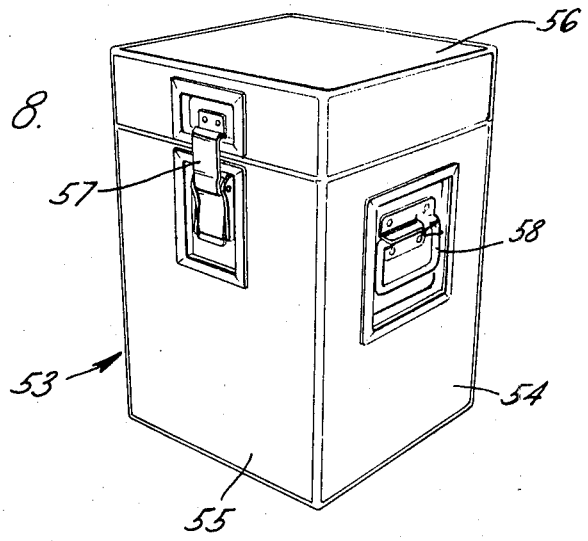
FIG. 8 is a perspective view of a container in accordance with the invention.

FIG. 8 illustrates a container 53 in accordance with the invention. The container has side panels 54, 55 and a lid 56. The lid 56 is secured by means of a clasp 57, and the side panels are provided with handles 58.

Whilst the invention has been described with particular reference to generally cubic containers it must be understood that the invention may be applied to containers of other shapes and to other structures.

It will be appreciated that containers made by the above described method utilizing the above described preferred materials will have joints which are flexible yet waterproof. Such containers have proved to be extremely rugged, well capable of withstanding violent shocks.

We claim:

1. A packaging container comprising a base and a plurality of side walls upstanding from the base, the base and each respective side wall being formed from a substantially rigid panel, there being joints between the base and each side wall and between each side wall and each adjacent side wall, each said joint comprising a member of cold cured elastomer which has been cured in situ and which forms a flexible element securing the panels together to form a packaging container having waterproof and flexible shock resistant joints between the substantially rigid panels.

2. The packaging container of claim 1 produced by a method comprising the steps of locating a number of said substantially rigid panels in a jig so that the panels are in the relative positions they will occupy in the finished structure with the adjacent edges of the panels nearly touching, locating mould means adjacent to the nearly touching edges, introducing said cold-curing elastomer into said mould means in flowable form, curing said elastomer in situ into a flexible element securing said panels together to form a structure forming element having a waterproof and shockproof joint, and subsequently securing at least one further panel to said structure forming element to form said container having waterproof and shockproof corners.

3. A packaging container as defined in claim 2 wherein two panels are connected at right angles to each other, the two panels, when interconnected but before they are connected to other panels, being movable to have an included angle of at least 135° without damaging the flexible joint connecting the panels.

4. A packaging container as defined in claim 3 wherein said included angle is 180°.

5. A packaging container as defined in claim 2 wherein two structure forming elements, each comprising two connected panels, are connected together by a method comprising the steps of locating said structure forming elements with appropriate edges of panels nearly touching, locating mould means adjacent to said nearly touching edges, and introducing said casting resin into said mould means to secure said panels together, whereby said structure forming elements are secured together.

6. A packaging container as defined in claim 5 wherein the container comprises four side panels formed from two structure forming elements, each said structure forming element comprising two mutually perpendicular panels, and two further panels.

7. A packaging container as defined in claim 5 wherein the container comprises four side panels which constitute a single structure forming element and two further panels.

8. A packaging container as defined in claim 5 wherein said further panels are subsequently added to said structure forming elements by positioning each further panel in a predetermined position relative to said structure forming elements, locating mould means adjacent edges of each further panels which are nearly touching said structure forming element, and introducing said elastomer in flowable form into said mould means, whereby each further panel is secured to said structure forming element.

9. The packaging container of claim 1 produced by a method comprising the steps of locating a number of said substantially rigid panels in a jig so that the panels are in the relative positions that they will occupy in the finished structure with the adjacent edges of the panels nearly touching, locating mould means immediately next to said nearly touching edges, introducing said cold-curing elastomer into said mould means in flowable form, curing said elastomer in situ into a flexible element connecting said panels together to form a structure forming element havng a waterproof and shockproof joint, subsequently securing at least one further panel to said structure forming element to form a container having waterproof and shockproof corners, and separating the container into two sections by cutting at least one panel thereof.

10. A packaging container as defined in claim 9 wherein the free edges formed by cutting said at least one panel are provided with sealing members.

11. A packaging container as defined in claim 10 wherein sid sealing members are provided by locating mould means adjacent the free edges, introducing a cold-curing elastomer in flowable form to said mould means and curing said elastomer in situ.

12. The packaging container of claim 1 including a lid comprising a top, a number of side walls equal to the number of side walls in the container, said top and side walls of said lid each being formed from a substantially rigid panel, joint members between said top and side panels and between adjacent edges of the side panels of said lid, said joint members comprising a cold cured elastomer cured in situ to form a flexible, waterproof and shock resistant element securing the panels of said lid together, and interlocking seal members along the confronting edges of the side panels in the container and lid, said interlocking seal members also comprising a cold cured elastomer cured in situ to form a flexible, waterproof and shock resistant seal between said container and lid.

13. The packaging container of either claim 1 or 12 wherein said cold cured elastomer is a polyurethane formed from polyether polyol and an isocyanate.

* * * * *